US007709771B2

(12) United States Patent
Kanzaki et al.

(10) Patent No.: US 7,709,771 B2
(45) Date of Patent: May 4, 2010

(54) PACKAGING POUCH FOR MICROWAVE OVEN

(75) Inventors: Keizou Kanzaki, Kanagawa (JP); Shie Nishimoto, Kanagawa (JP); Taketo Sakurai, Kanagawa (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 974 days.

(21) Appl. No.: 10/570,269

(22) PCT Filed: Aug. 31, 2004

(86) PCT No.: PCT/JP2004/001294

§ 371 (c)(1),
(2), (4) Date: Jun. 2, 2006

(87) PCT Pub. No.: WO2005/023676

PCT Pub. Date: Mar. 17, 2005

(65) Prior Publication Data

US 2007/0023425 A1 Feb. 1, 2007

(30) Foreign Application Priority Data

Sep. 2, 2003 (JP) ..... 2003-309583

(51) Int. Cl.
*H05B 6/80* (2006.01)

(52) U.S. Cl. ..... 219/727; 219/730; 426/107

(58) Field of Classification Search ..... 219/727–732, 219/735, 740, 759, 763; 99/DIG. 14; 426/234, 426/241, 113, 115, 118, 243, 107, 87
See application file for complete search history.

(56) References Cited

U.S. PATENT DOCUMENTS

| | | | | |
|---|---|---|---|---|
| 6,060,096 | A * | 5/2000 | Hanson et al. | 426/107 |
| 2003/0123758 | A1 | 7/2003 | Mita et al. | |

FOREIGN PATENT DOCUMENTS

| | | | | |
|---|---|---|---|---|
| CA | 2470054 | A1 | | 6/2003 |
| JP | 10-059433 | A | | 3/1998 |
| JP | 10-230978 | A | | 9/1998 |
| JP | 10230978 | A | * | 9/1998 |
| JP | 11-130159 | A | | 5/1999 |
| JP | 11130159 | A | * | 5/1999 |
| JP | 2000-191056 | A | | 7/2000 |
| JP | 2000-309348 | A | | 11/2000 |
| JP | 2001-106270 | A | | 4/2001 |
| JP | 2002-080072 | A | | 3/2002 |

(Continued)

*Primary Examiner*—Quang T Van
(74) *Attorney, Agent, or Firm*—Sughrue Mion, PLLC

(57) ABSTRACT

An inexpensive packaging pouch for use in a microwave oven, in which the packaging pouch can be prevented from opening at the base part of a branch section when used for retorting or for cooking in the microwave oven, and pressure in the packaging pouch can be automatically released when the pouch is used for cooking in the microwave oven. A packaging pouch for microwave oven hermetically sealed by heat-sealing a plastic film is provided with a branch section, and a vapor release seal part having at least one weakened part is formed at the branch section. Opening preventive means are provided at the branch section and inside a peripheral edge seal part, facing the branch section, of a packaging pouch body.

10 Claims, 13 Drawing Sheets

FOREIGN PATENT DOCUMENTS

| | | | | |
|---|---|---|---|---|
| JP | 2002-511369 | A | | 4/2002 |
| JP | 2002511369 | A | * | 4/2002 |
| JP | 2003-002374 | A | | 1/2003 |
| JP | 2003002374 | A | * | 1/2003 |
| JP | 2003-081360 | A | | 3/2003 |
| JP | 2003-182779 | A | | 7/2003 |
| WO | WO 99/52790 | A1 | | 10/1999 |
| WO | 03/051745 | A1 | | 6/2003 |

* cited by examiner (A)

(B)

PACKAGING POUCH FOR MICROWAVE OVEN

TECHNICAL FIELD

The present invention relates to a packaging pouch for a microwave oven capable of automatically releasing vapor or the like to be generated inside the packaging pouch filled with a content such as a retort food containing a liquid substance, a solid substance, or a mixture thereof under heating in the microwave oven, and capable of preventing burst or deformation of the packaging pouch and scattering of the content.

BACKGROUND ART

Heating of a packaging pouch hermetically filled with a retort food, a frozen food, or the like in a microwave oven increases the pressure inside the pouch due to water vapor or the like being generated from its content under heating. The packaging pouch may tear, and the content may scatter, to thereby make the inside of the microwave oven dirty or harm a human body by burning or the like.

Thus, before heat-cooking such a packaging pouch in a microwave oven, a method of preventing tearing of the packaging pouch is employed. That is, the packaging pouch is partly opened in advance or the packaging pouch itself is pierced, to thereby discharge water vapor or the like that is generated inside the packaging pouch.

However, such a method involves much time and effort for a general consumer. Further, this method has a disadvantage in that flavor is lost because the water vapor generated by microwave heating is immediately discharged out of the packaging pouch and heat steaming effect of the water vapor on the content is reduced.

There are known various packaging pouches each provided with means for automatically relieving an increase in the inner pressure of the packaging pouch under heating in a microwave oven. Proposed examples of a conventional technique include: (1) a packaging pouch provided with a butt-seam part that is seamed to the packaging pouch through a heat seal of a predetermined width, in which the butt-seam part is formed of an easily opened seal (JP-A-2001-106270, for example); (2) a packaging pouch provided with a weak seal part partly formed in a heat seal part of the packaging pouch by interposing a thin film, and partly provided with a narrow seal part of a small heat seal width in the weak seal part (JP-A-10-59433); and (3) a packaging pouch provided with a branched section (fin part), and provided with automatic opening means for inner vapor in the branched section (see JP-A-2002-80072, JP-A-2003-2374, and JP-A-2003-81360).

However, the packaging pouch provided with automatic opening means for inner vapor in the branched section as described in the conventional technique (3) has a problem in that a heat seal part of the packaging pouch peels off from a base part of the branched section during retort treatment under conditions of 120° C. for 30 minutes or during heat-cooking of the packaging pouch filled with a contents with a high power microwave oven, such that the packaging pouch is liable to open to leak the contents or is liable to tear.

Thus, an object of the present invention is to provide at a low cost a packaging pouch for a microwave oven having a branched section capable of preventing opening of the packaging pouch from a base part of the branched section during retort treatment or during heat-cooking in a microwave oven and capable of automatically releasing pressure inside the packaging pouch during heat-cooking in a microwave oven.

DISCLOSURE OF THE INVENTION

In the present invention, a packaging pouch for a microwave oven having a branched section includes opening preventive means on an inner side of a peripheral edge seal part of each of the branched section and a packaging pouch body opposing the branched section.

That is, the present invention employs the following structures 1 to 11.

1. A packaging pouch for a microwave oven, which is hermetically sealed by heat-sealing a plastic film, including: a branched section; and a vapor release seal part having at least one weakened part formed in the branched section, characterized in that opening preventive means are formed on an inner side of a peripheral edge seal part of each of the branched section and a packaging pouch body opposing the branched section.
2. The packaging pouch for a microwave oven according to the above item 1, characterized in that the vapor release seal part is formed continuously with respect to the peripheral edge seal part of the branched section.
3. The packaging pouch for a microwave oven according to the above item 1, characterized in that the vapor release seal part is formed separately from the peripheral edge seal part of the branched section.
4. The packaging pouch for a microwave oven according to the above item 1, characterized in that the vapor release seal part is provided with a through-hole, a semi through-hole, or a slit to thereby form a weakened part.
5. The packaging pouch for a microwave oven according to the above item 1, characterized in that a notch is formed in the branched section of the packaging pouch inwardly into the pouch and a periphery edge of the notch is heat sealed to thereby form the vapor release seal part having the weakened part.
6. The packaging pouch for a microwave oven according to the above item 1, characterized by satisfying the following expressions (1) to (4):

$$D \geqq A+B \quad (1);$$

$$A \geqq C \quad (2);$$

$$B \geqq C \quad (3); \text{ and}$$

$$E \geqq 2A \quad (4),$$

wherein: A represents an inner length of a short side of a packaging pouch body opposing the branched section; B represents an inner height of the branched section; C represents a height of a lower end of the vapor release seal part provided in the branched section; D represents an inner length of a short side of the packaging pouch; and E represents an inner length of a long side of the packaging pouch including the section opposing the branched section.

7. The packaging pouch for a microwave oven according to the above item 1, characterized in that the plastic film forming the packaging pouch is heat-sealed to thereby form the opening preventive means.
8. The packaging pouch for a microwave oven according to the above item 7, characterized in that the branched section is removed along an outer periphery of the opening preventive means formed in the branched section.
9. The packaging pouch for a microwave oven according to the above item 1, characterized in that the peripheral edge seal part and the vapor release seal part each have a sealing strength of 2.3 kg/15 mm or more.

10. The packaging pouch for a microwave oven according to the above item 1, characterized in that pouring port forming means is formed at the periphery edge seal part of body of the packaging pouch opposing the branched section.
11. The packaging pouch for a microwave oven according to the above item 10, characterized in that laser processing is performed at an intended opening position to thereby form pouring port forming means.

BRIEF DESCRIPTION OF THE DRAWINGS

FIG. 11(A) is a perspective view of the packaging pouch. FIG. 11(B) is a diagram of the packaging pouch seen from a direction of an arrow of FIG. 11(A) in which the branched section and the opposing section are opened to 180°.

FIG. 16 is a diagram explaining an appropriate height of a branched section of a packaging pouch for a microwave oven according to the present invention, appropriate lengths of sides of the packaging pouch, an appropriate position for providing a vapor release seal part, and the like.

BEST MODE FOR CARRYING OUT THE INVENTION

Figure 1:
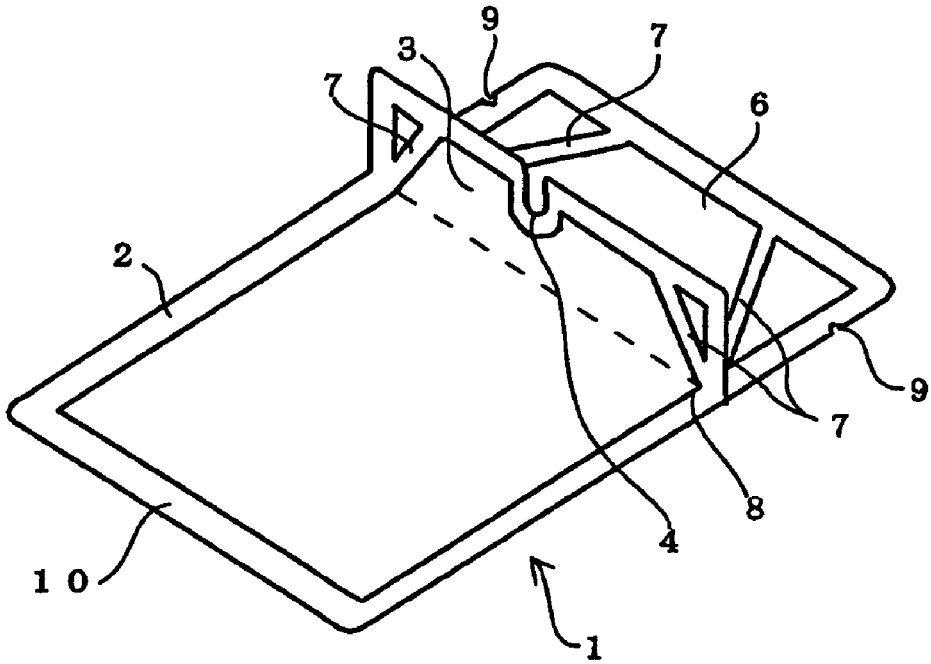
FIG. 1 is a diagram showing an example of a packaging pouch for a microwave oven according to the present invention, and is a perspective view of the packaging pouch in a state where a branched section stands upright.

A plastic film forming a packaging pouch for a microwave in the present invention employs a plastic material having heat sealing property and generally used for production of a packaging pouch. Examples of such a plastic material include: monolayer films or sheets each formed of a thermoplastic resin having heat sealing property; and multilayer films each prepared by laminating a thermoplastic resin having a heat sealing property and another thermoplastic resin or the like.

Examples of such a plastic material having heat sealing property include: a known olefin resins such as low density polyethylene, a linear low density polyethylene, a medium density polyethylene, a high density polyethylene, a polypropylene, a propylene-ethylene copolymer, an ethylene-vinyl acetate copolymer, an olefin-based resin subjected to graft modification with an ethylene-based unsaturated carboxylic acid or an anhydride thereof; a polyamide resin or copolyamide resin having a relatively low melting point or relatively low softening point; a polyester resin or copolyester resin; and a polycarbonate resin.

An example of another plastic material to be laminated with the plastic material having a heat sealing property is a thermoplastic resin or various barrier films each having a heat sealing property or having no heat sealing property.

Examples of such thermoplastic resin can include: polyolefins such as crystalline polypropylene, a crystalline propylene-ethylene copolymer, crystalline polybutene-1, crystalline poly4-methylpentene-1, low-density polyethylene, medium-density polyethylene, high-density polyethylene, an ethylene-vinyl acetate copolymer (EVA), a saponified product of an EVA copolymer, an ethylene-ethyl acrylate copolymer (EEA), and an ion-crosslinked olefin copolymer (ionomer); aromatic vinyl copolymers such as polystyrene and a styrene-butadiene copolymer; vinyl halide polymers such as polyvinyl chloride and a vinylidene chloride resin; a polyacrylic resin; nitrile polymers such as an acrylonitrile-styrene copolymer and an acrylonitrile-styrene-butadiene copolymer; polyesters such as polyethylene terephthalate and polytetramethylene terephthalate; various polycarbonates; a fluorine-based resin; and polyacetals such as polyoxymethylene. Those thermoplastic resins can be used independently, or with being blended with two or more kinds of them. Furthermore, a thermoplastic resin may be used to be blended with various additives.

In addition, examples of various barrier films can include: a silica-deposited polyester film; an alumina-deposited polyester film, a silica-deposited nylon film, an alumina-deposited nylon film, an alumina-deposited polypropylene film, a carbon film-deposited polyester film, and a carbon film-deposited nylon film; a co-deposited film obtained by simultaneously depositing alumina and silica from the vapor onto a base film such as a polyester film or a nylon film; a film obtained by co-extruding nylon 6/metha-xylylene diamine nylon 6 and a film obtained by co-extruding a polypropylene/ethylene-vinyl alcohol copolymer; an organic resin-coated film such as a polyvinyl alcohol-coated polypropylene film, a polyvinyl alcohol-coated polyester film, a polyvinyl alcohol-coated nylon film, a polyacrylic acid-based resin-coated polyester film, a polyacrylic acid-based resin-coated nylon film, a polyacrylic acid-based resin-coated polypropylene film, a polyglycolic acid resin-coated polyester film, a polyglycolic acid resin-coated nylon film, and a polyglycolic acid resin-coated polypropylene film; and a film obtained by coating a hybrid coating material consisting of an organic resin material and an inorganic material on a base film such as a polyester film, a nylon film, or a polypropylene film. Those barrier films can be used independently, or in combination with two or more kinds of them.

In the present invention, the packaging pouch for a microwave oven is formed by heat sealing an unoriented, or uniaxially or biaxially oriented film formed of the above-mentioned plastic material through a conventional method. In the case where the film is a laminate film of a thermoplastic resin having heat sealing property and a thermoplastic resin having no heat sealing property, the laminate film is heat sealed such that the thermoplastic resin layer having heat sealing property forms an inner surface of the packaging pouch.

Hereinafter, structures of the packaging pouch for a microwave oven according to the present invention will be described with reference to diagrams.

Figure 3:
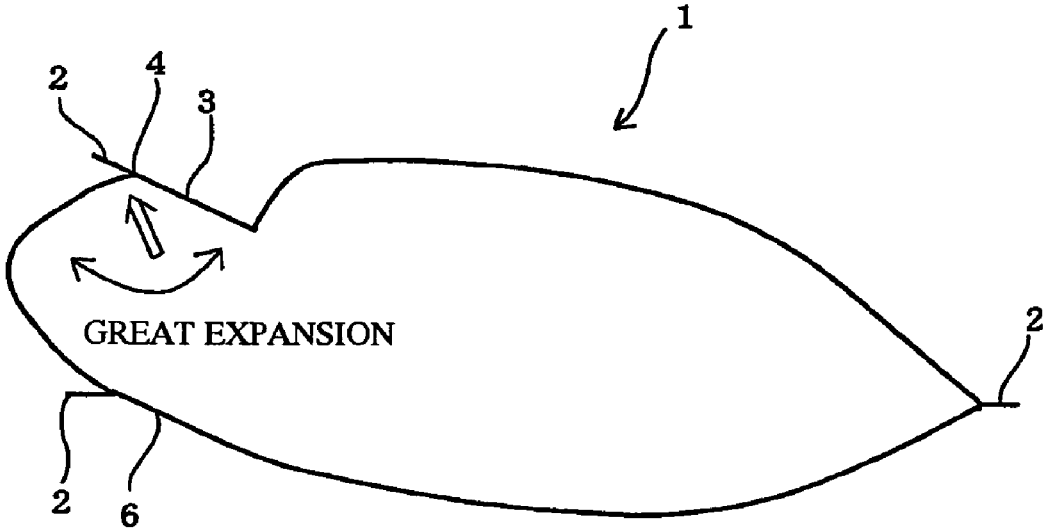
FIG. 3 is a schematic diagram showing a state of the packaging pouch of FIG. 1 under heating in a microwave oven.
Figure 2:
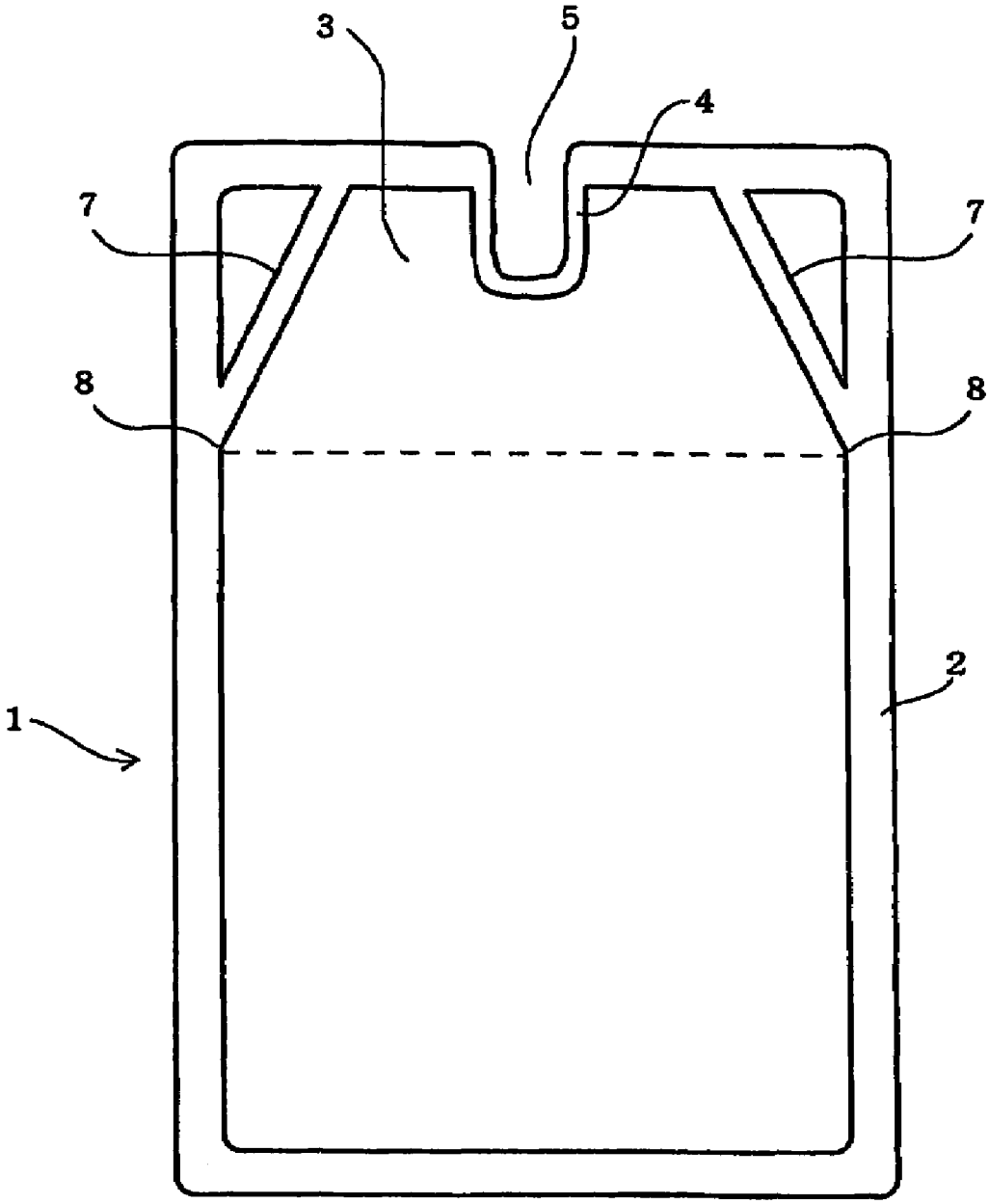
FIG. 2 is a plan view of the packaging pouch of FIG. 1 in a state where the branched section is laid down.
Figure 4:
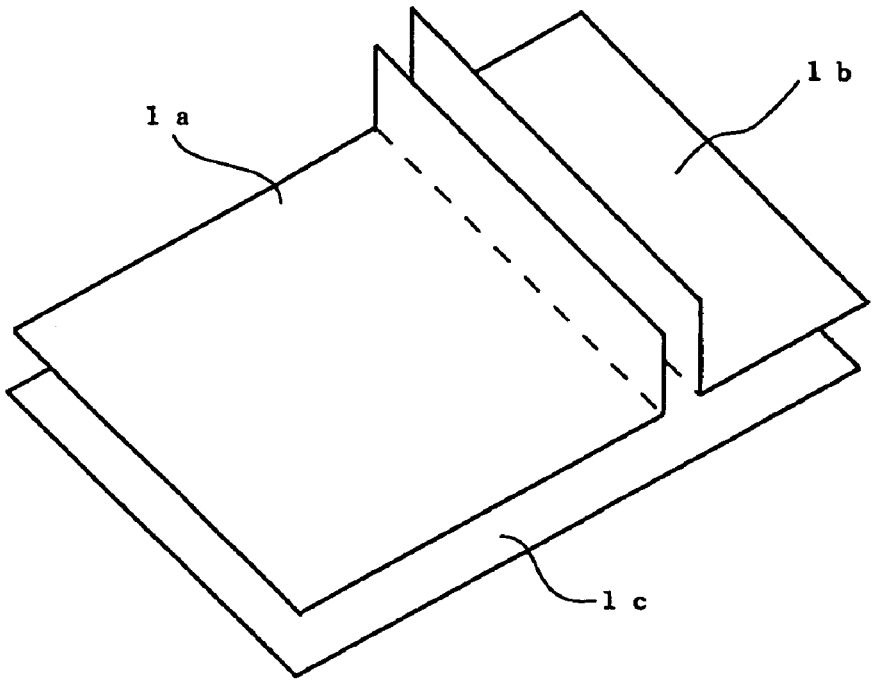
FIG. 4 is a diagram explaining a procedure for producing the packaging pouch of FIG. 1.

FIGS. 1 to 4 show an example of the packaging pouch for a microwave oven according to the present invention. FIG. 1 is a perspective view of the packaging pouch in a state where a branched section stands upright. FIG. 2 is a plan view of the packaging pouch in a state where the branched section lies down. FIG. 3 is a schematic diagram showing a state of the packaging pouch under heating in a microwave oven. FIG. 4 is a diagram explaining a procedure for producing the packaging pouch.

A branched section 3 capable of being laid down is provided on one side of a packaging pouch 1. An upper edge part of the branched section 3 is provided with a vapor release seal part 4 having a weakened part 5 prepared by providing a notch formed inwardly into the pouch and by heat sealing a periphery edge of the notch at an equal width to that of a peripheral edge seal part 2 or at a smaller width than that of the peripheral edge seal part 2. Then, opening preventive means 7 is provided by heating sealing a plastic film forming the packaging pouch 1 on an inner side of the peripheral edge seal part 2 of each of the branched section 3 and a packaging pouch body opposing the branched section (hereinafter, referred to as "opposing section") 6.

As shown in FIG. 4, for example, the packaging pouch 1 can be produced by heat sealing a peripheral edge part of each of three plastic films 1*a*, 1*b*, and 1*c*. In this case, a content filling port 10 is formed with an unsealed short side of the packaging pouch, and then the filling port 10 is heat sealed after the content is filled into the packaging pouch from the filling port 10, to thereby hermetically seal the packaging pouch. The hermetically sealed packaging pouch is subjected to retort treatment under the condition of 120° C. for 30 minutes.

As shown in FIG. 3, the packaging pouch 1 expands due to water vapor or the like to be generated from the content when the hermetically sealed packaging pouch 1 containing a content is heat-cooked in a microwave oven. In particular, the packaging pouch expands greatly in the branched section 3 and the opposing section 6, and concentrated stress is generated at the vapor release seal part 4 (white arrow in FIG. 3), to thereby start peeling of the vapor release seal part 4 from an end closer to the center of the pouch. The seal part 4 recedes with an increase in the inner pressure of the pouch. The packaging pouch 1 partly opens when the peeling reaches the weakened part 5. As a result, the water vapor or the like is discharged out of the packaging pouch, to thereby prevent tearing of the packaging pouch.

The conventional packaging pouch for a microwave oven having a branched section as described in the conventional technique (3) has problems in that a heat seal part peels off from the base part 8 of the branched section 3 and that the packaging pouch 1 opens at the base part 8 during retort treatment of the packaging pouch filled with a content or during heat-cooking of the packaging pouch with a microwave oven such that the content leaks out or the pouch is torn. The packaging pouch 1 of the present invention is provided with opening preventive means 7 formed of a heat seal part at a total of four positions on an inner side of the periphery edge seal part 2 of each of the branched section 3 and the opposing section 6, to thereby prevent peeling of the peripheral edge seal part at the base part 8 of the branched section 3.

The opening preventive means 7 must be provided at total of four positions on both sides of each of the branched section 3 and the opposing section 6. In the case where the opening preventive means 7 is provided in the branched section 3 alone, the periphery edge seal part may peel off from the base part 8 of the opposing section 6 that is provided with no opening preventive means 7.

Both sides of the periphery edge seal part of the opposing section 6 of the packaging pouch 1 are each provided with pouring port forming means 9 formed of a notch, to thereby allow easy formation of a content pouring port after heat-cooking. The pouring port forming means can be formed through machine work such as perforation or scoring, laser processing, or the like.

Figure 5:
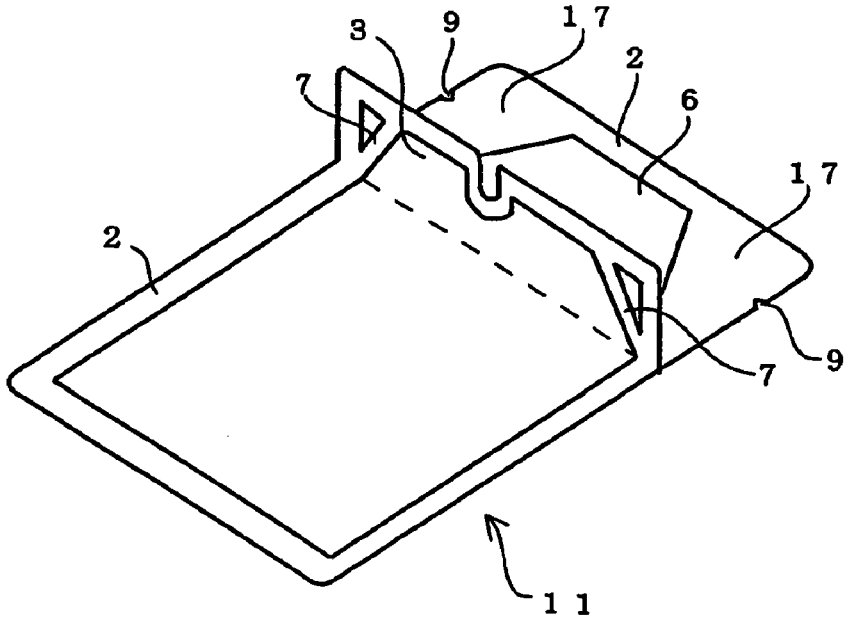
FIG. 5 is a perspective view showing another example of the packaging pouch for a microwave oven according to the present invention.

FIG. 5 is a perspective view showing another example of the packaging pouch for a microwave oven according to the present invention.

In a packaging pouch 11, opening preventive means 17 is formed by heat sealing an entire region surrounded by the opening preventive means 7 provided in the opposing section 6 of the packaging pouch 1 of FIG. 1 and the peripheral edge seal part 2. Other structures of the packaging pouch 11 are the same as those of the packaging pouch 1 of FIG. 1.

The opening preventive means 17 each serve as a grip for opening the packaging pouch 11 after heat-cooking in a microwave oven, and facilitate opening of the pouch or taking out of the content.

Figure 6:
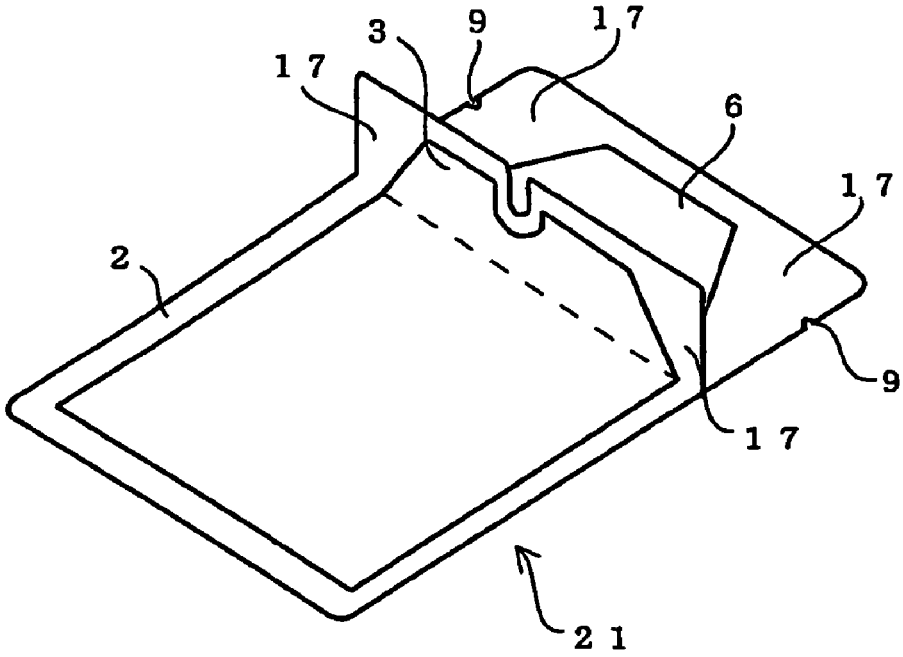
FIG. 6 is a perspective view showing still another example of the packaging pouch for a microwave oven according to the present invention.

FIG. 6 is a perspective view showing still another example of the packaging pouch for a microwave oven according to the present invention.

In a packaging pouch 21, the opening preventive means 17 is formed by heat sealing an entire region surrounded by the opening preventive means 7 provided in the branched section 3 of the packaging pouch 11 of FIG. 5 and the peripheral edge seal part 2. Other structures of the packaging pouch 21 are the same as those of the packaging pouch 11 of FIG. 5.

Figure 7:
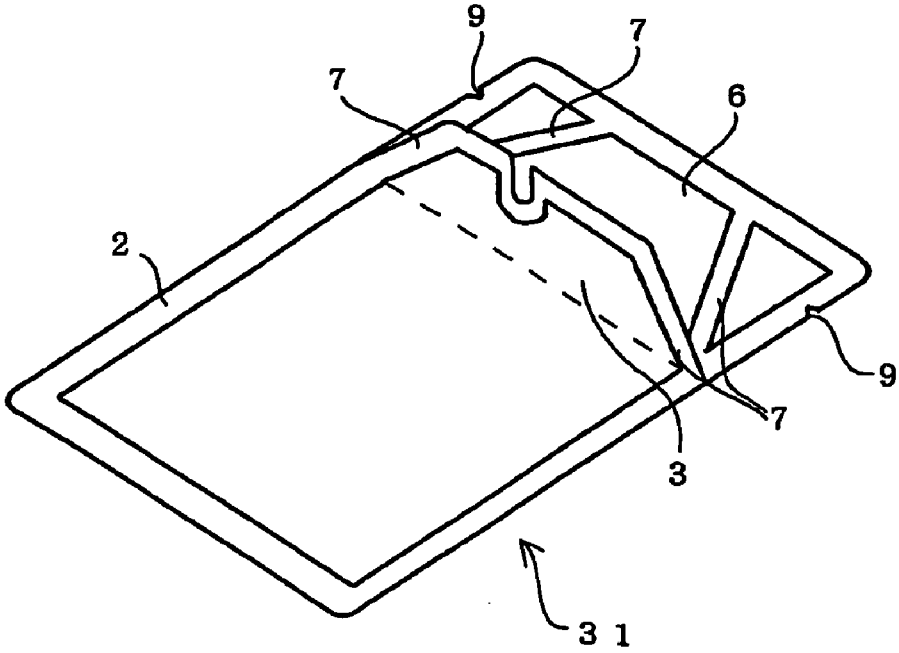
FIG. 7 is a perspective view showing yet another example of the packaging pouch for a microwave oven according to the present invention.

FIG. 7 is a perspective view showing yet another example of the packaging pouch for a microwave oven according to the present invention.

In a packaging pouch 31, the branched section 3 is removed along an outer periphery of the opening preventive means 7 formed in the branched section 3 of the packaging pouch 1 of FIG. 1. Other structures of the packaging pouch 31 are the same as those of the packaging pouch 1 of FIG. 1.

Note that the opening preventive means 7 to be formed in the opposing section 6 may also be formed by heat sealing an entire region surrounded by the opening preventive means 7 and the peripheral edge seal part 2 as in the packaging pouch 11 of FIG. 5.

Figure 8:
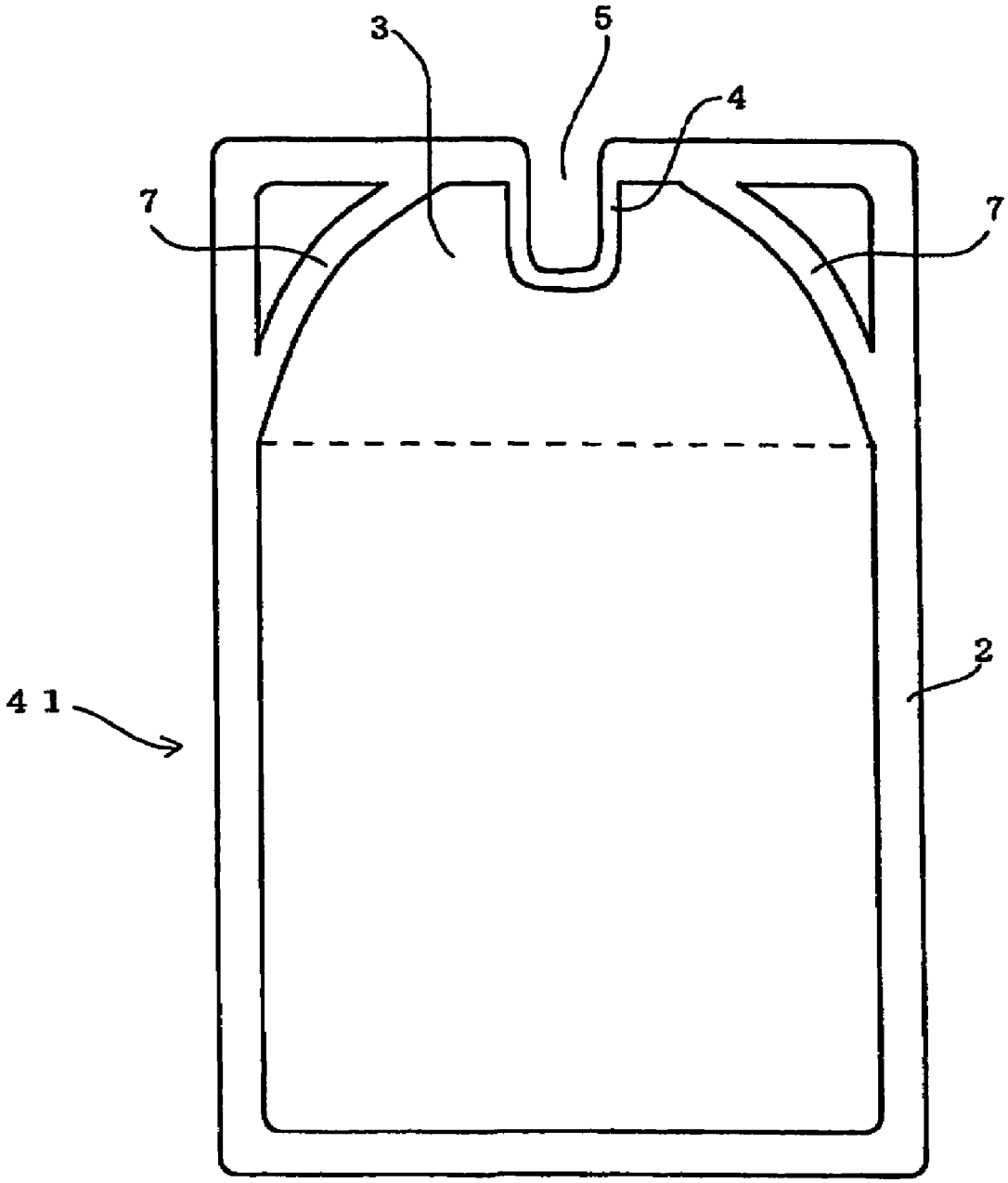
FIG. 8 is a plan view showing still yet another example of the packaging pouch for a microwave oven according to the present invention.

FIG. 8 is a plan view showing still yet another example of the packaging pouch for a microwave oven according to the present invention.

In a packaging pouch 41, the opening preventive means 7 formed in the branched section 3 of the packaging pouch 1 of FIGS. 1 and 2 each have a round arc shape. Other structures of the packaging pouch 41 are the same as those of the packaging pouch 1 of FIGS. 1 and 2.

Note that in the packaging pouch 41, the opening preventive means 7 to be formed in the branched section 3 or the opposing section 6 may obviously be changed to those in the packaging pouch of each of FIGS. 5 to 7.

Figure 9:
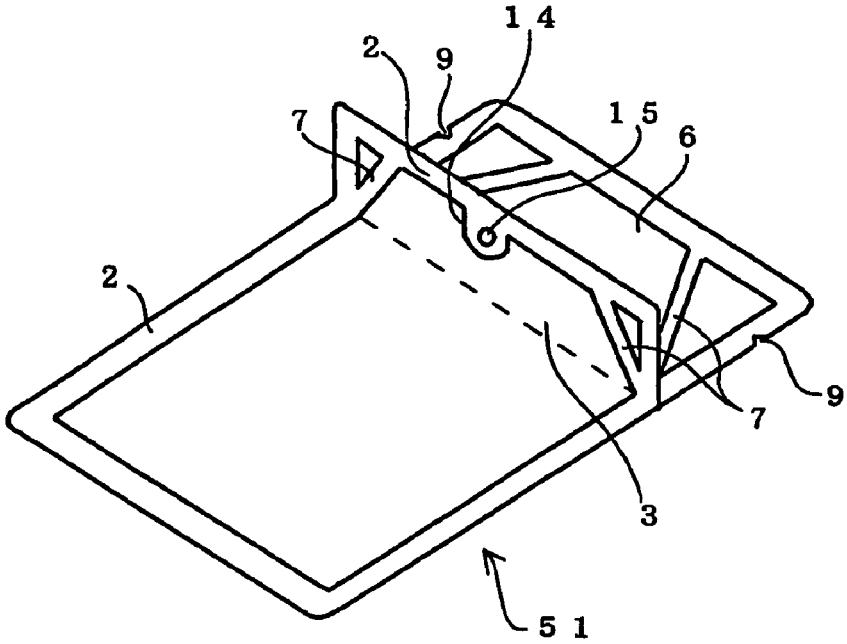
FIG. 9 is a perspective view showing an example of the packaging pouch for a microwave oven according to the present invention.

FIG. 9 is a perspective view showing an example of the packaging pouch for a microwave oven according to the present invention.

In a packaging pouch 51, a vapor release seal part 14 is formed continuously with respect to the peripheral edge seal part 2 of the branched section 3, and the vapor release seal part 14 is provided with a through-hole, to thereby form a weakened part 15. Other structures of the packaging pouch 51 are the same as those of the packaging pouch 1 of FIG. 1.

In the packaging pouch 51, the weakened part 15 is formed by providing the vapor release seal part 14 with a through-hole. However, as described in the conventional technique (3), the weakened part 15 may be formed by providing the vapor release seal part 14 with a semi through-hole, a slit, a dotted pattern seal, or the like instead of a through-hole.

Further, in the packaging pouch 51, the opening preventive means 7 to be formed in the branched section 3 or the opposing section 6 may obviously be changed to those in the packaging pouch of each of FIGS. 5 to 7.

Figure 10:
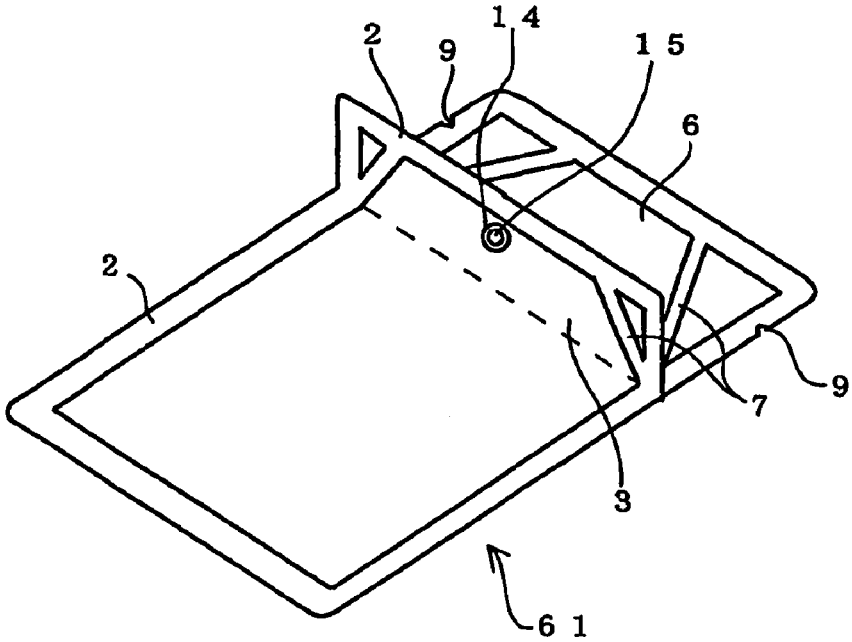
FIG. 10 is a perspective view showing another example of the packaging pouch for a microwave oven according to the present invention.

FIG. 10 is a perspective view showing another example of the packaging pouch for a microwave oven according to the present invention.

In a packaging pouch 61, the vapor release seal part 14 was formed separately from the peripheral edge seal part 2 of the branched section 3 in the packaging pouch 51 shown in FIG. 9. Other structures of the packaging pouch 61 are the same as those of the packaging pouch 51 of FIG. 9.

Figure 11:
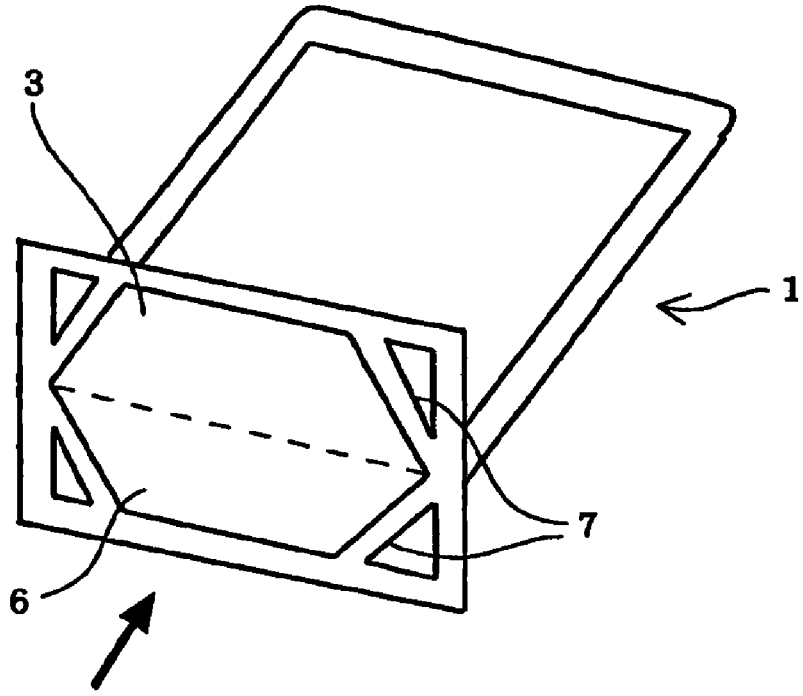
FIG. 11 is a schematic diagram explaining positions of the opening preventive means to be provided in a branched section and an opposing section of a packaging pouch for a microwave oven according to the present invention.
Figure 11:
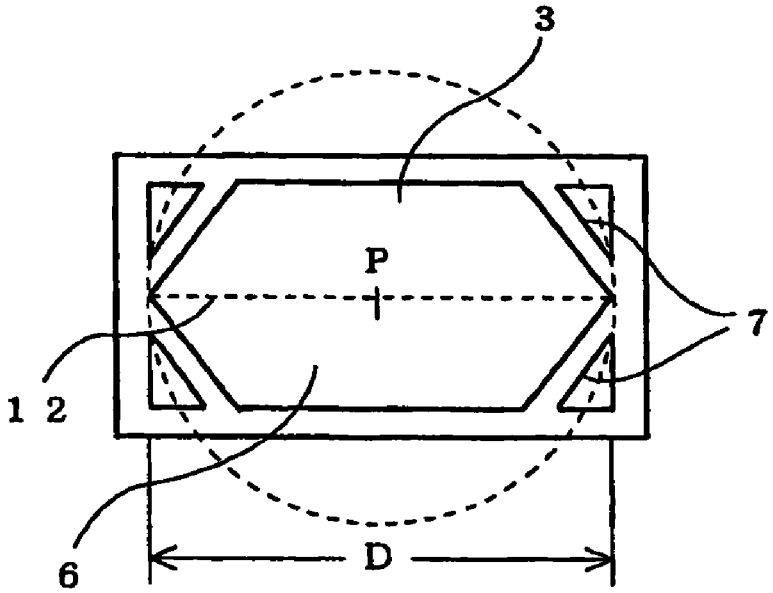
Figure 12:
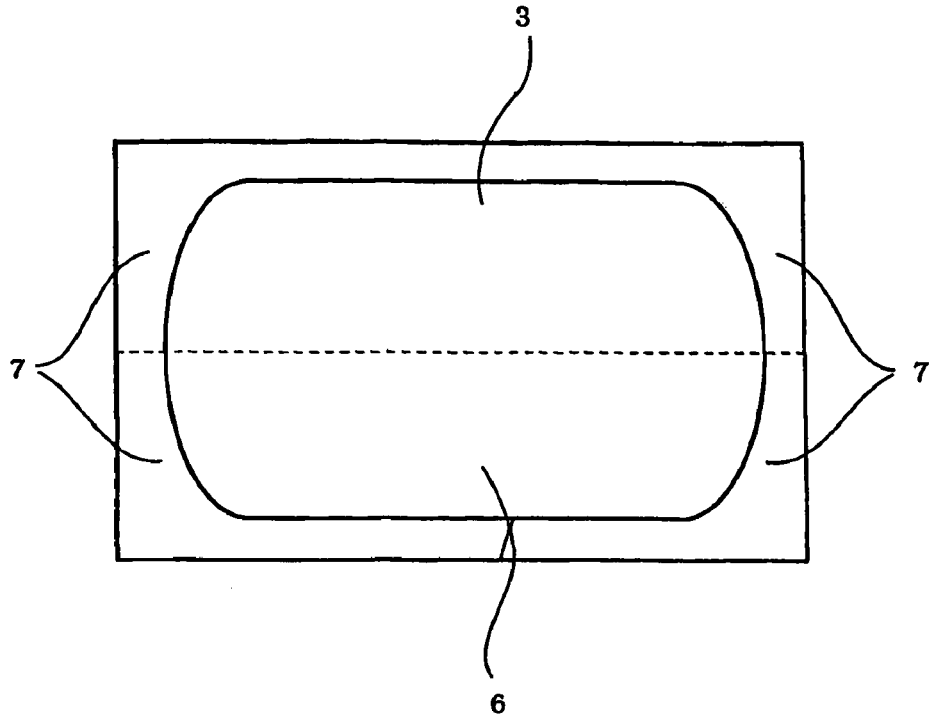
FIGS. 12 to 15 each show an example of the opening preventive means to be formed in the branched section and the opposing body of the packaging pouch according to the present invention, and are each a schematic diagram similar to FIG. 11(B).
Figure 13:
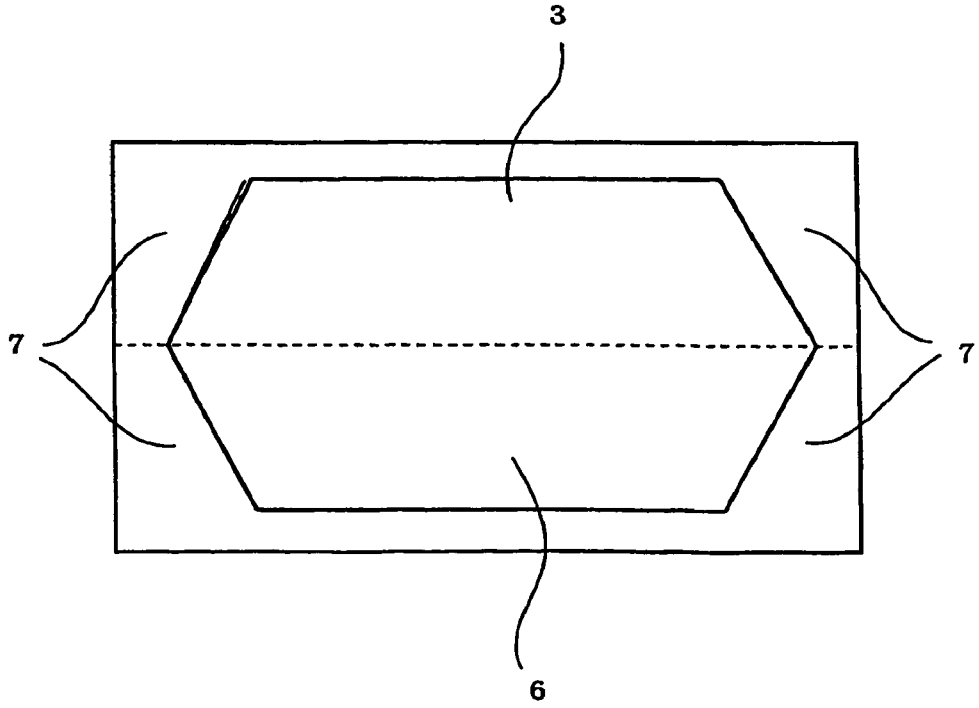
Figure 14:
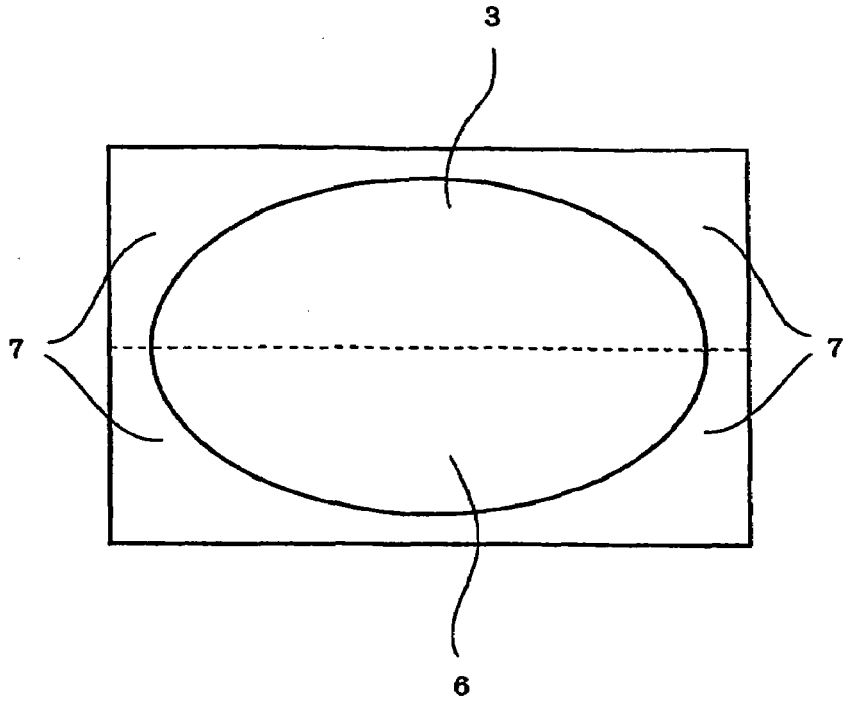
Figure 15:
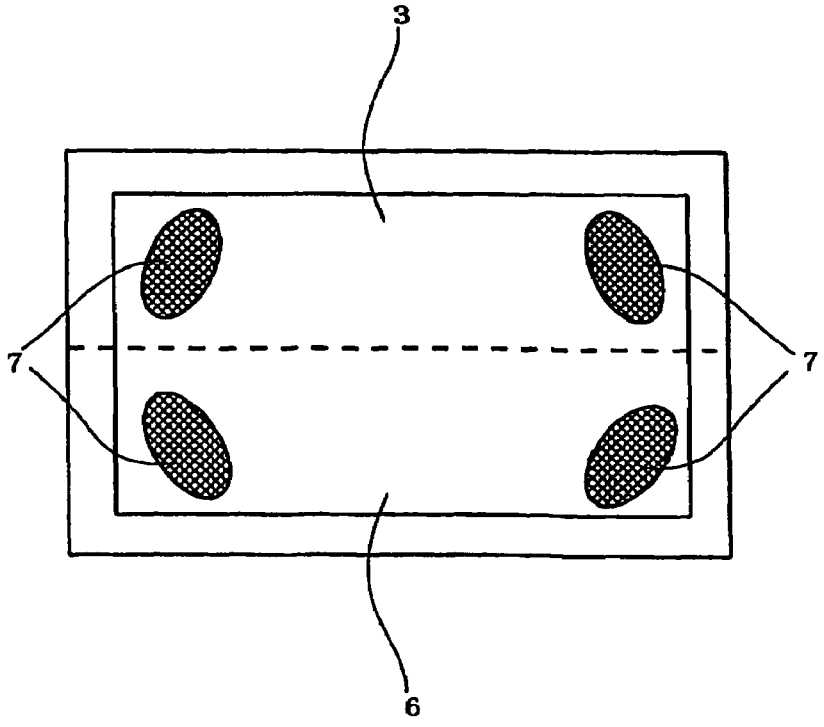

FIG. 11 is a schematic diagram explaining positions of the opening preventive means to be provided in a branched section and an opposing section of a packaging pouch for a microwave oven according to the present invention. FIG. 11(A) is a perspective view of the packaging pouch. FIG. 11(B) is a diagram of the packaging pouch seen from a direction of an arrow of FIG. 11(A) in which the branched section and opposing body of the packaging pouch are opened to 180°.

As shown in FIG. 11(B), the four opening preventive means 7 to be provided in the branched section 3 and the opposing section 6 of the packaging pouch 1 are each preferably provided such that the opening preventive means 7 is partly positioned within a circle inscribed in an inner edge of short sides of a rectangular region formed by an inner edge of the peripheral edge seal part 2 of each of the branched section 3 and the opposing section 6 opened to 180°. The circle has a diameter as a length D of a long side of the rectangular region and a center P as a midpoint of a boundary line 12 between the branched section 3 and the opposing section 6.

FIGS. 12 to 15 each show an example of the opening preventive means 7 to be formed in the branched section 3 and the opposing section 6 of the packaging pouch of the present invention. In the packaging pouch of each of FIGS. 12 to 14, the opening preventive means 7 are formed integrally with a peripheral edge seal part. In the packaging pouch of FIG. 15, the opening preventive means 7 are provided separately from the peripheral edge seal part.

Figure 16:
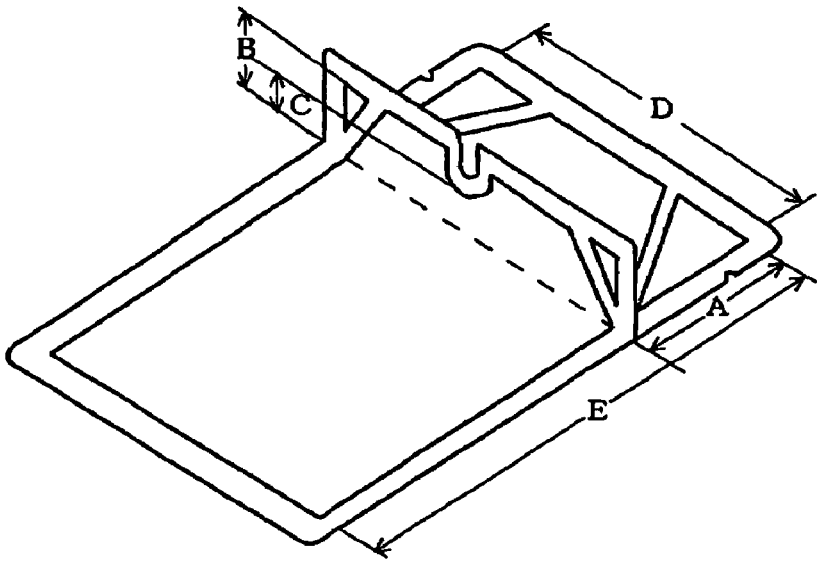
Figure 17:
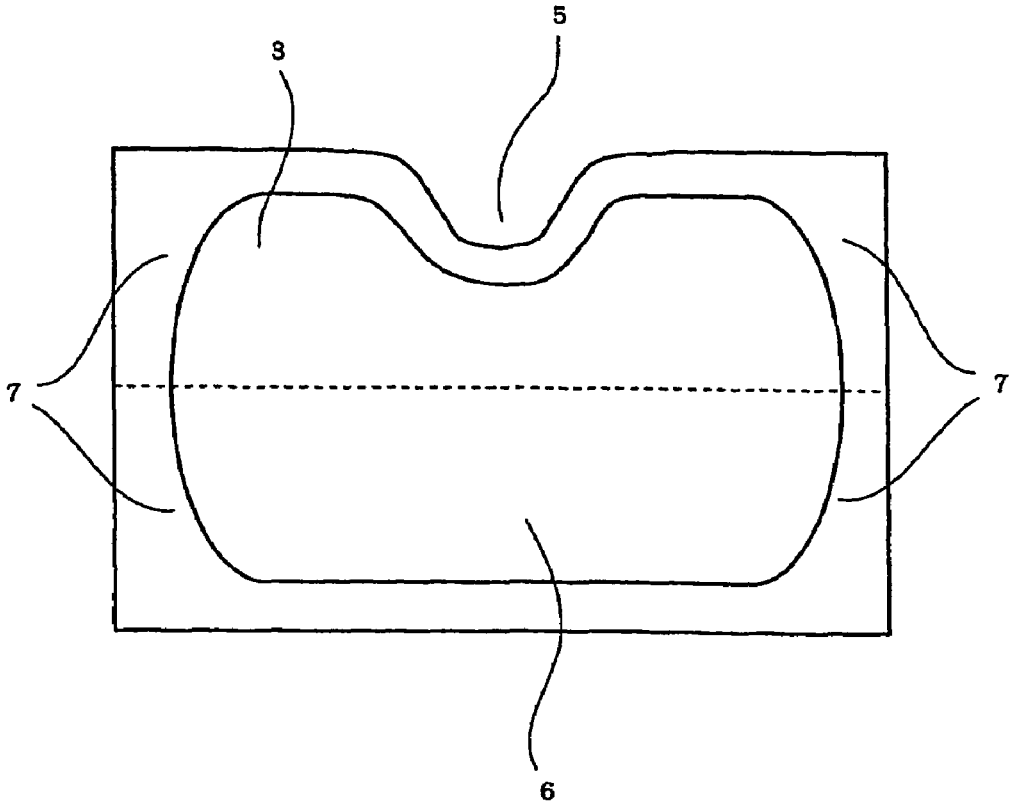
FIGS. 17 to 23 are each a schematic diagram showing an example of the branched section and the opposing body of the packaging pouch according to the present invention, and are each a schematic diagram similar to FIG. 11(B).
Figure 18:
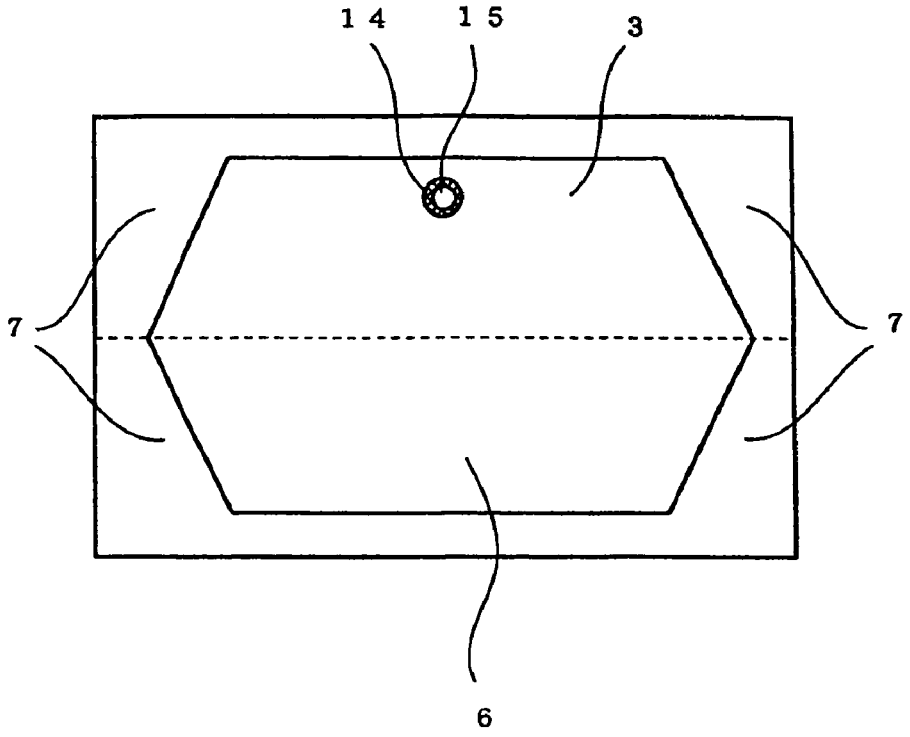
Figure 19:
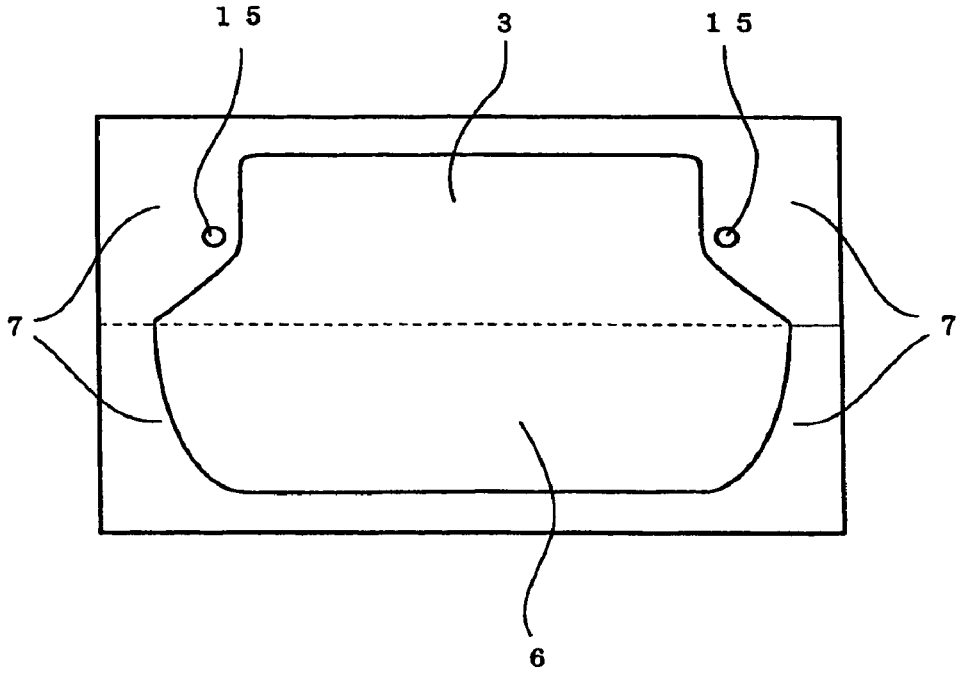
Figure 20:
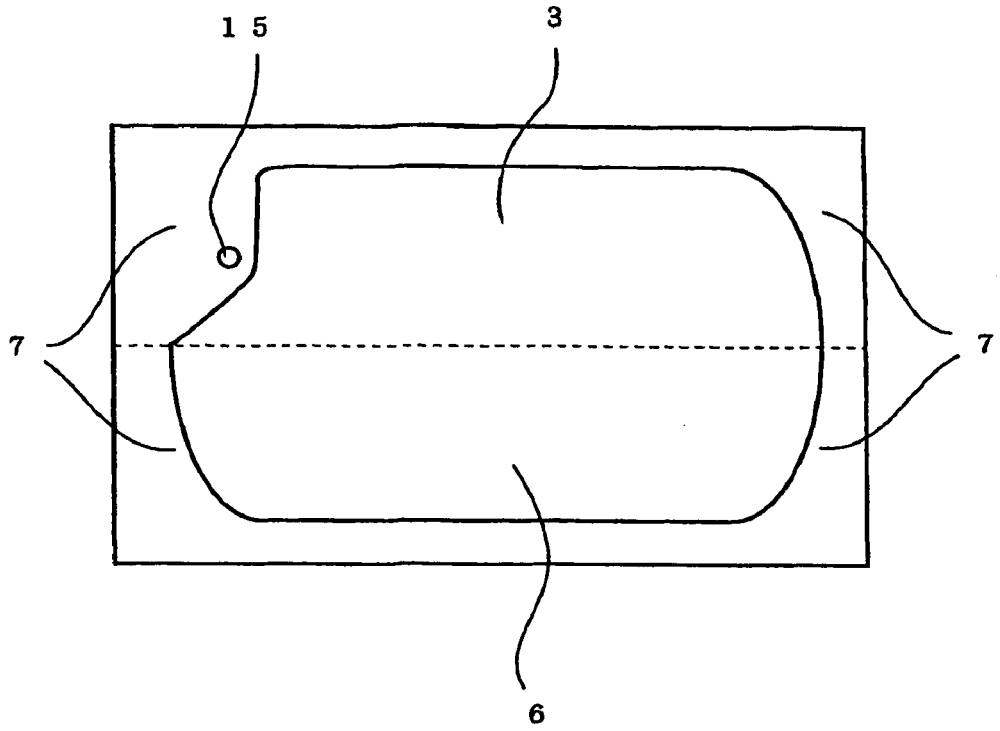
Figure 21:
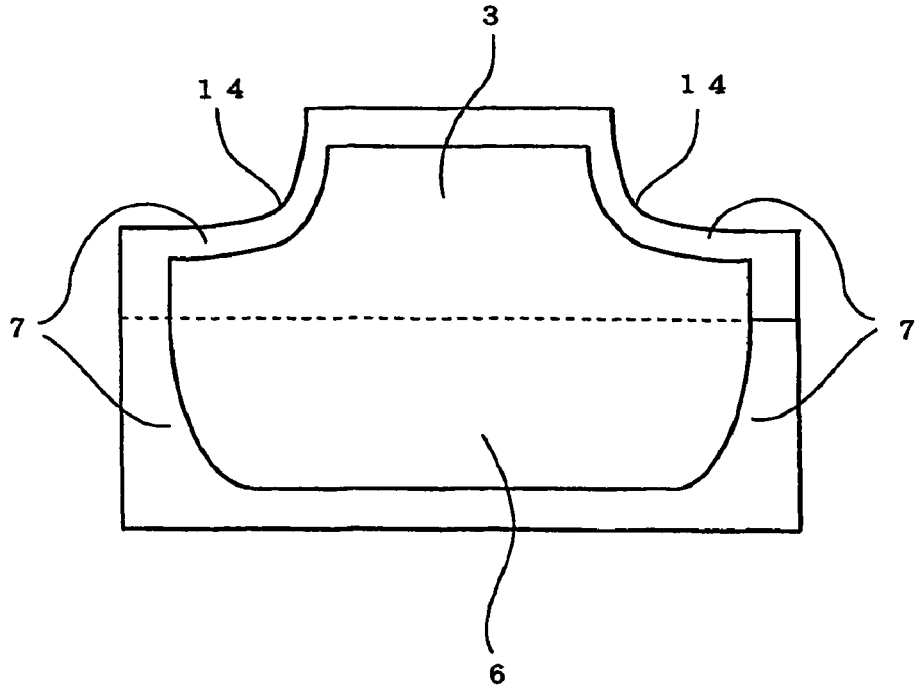
Figure 22:
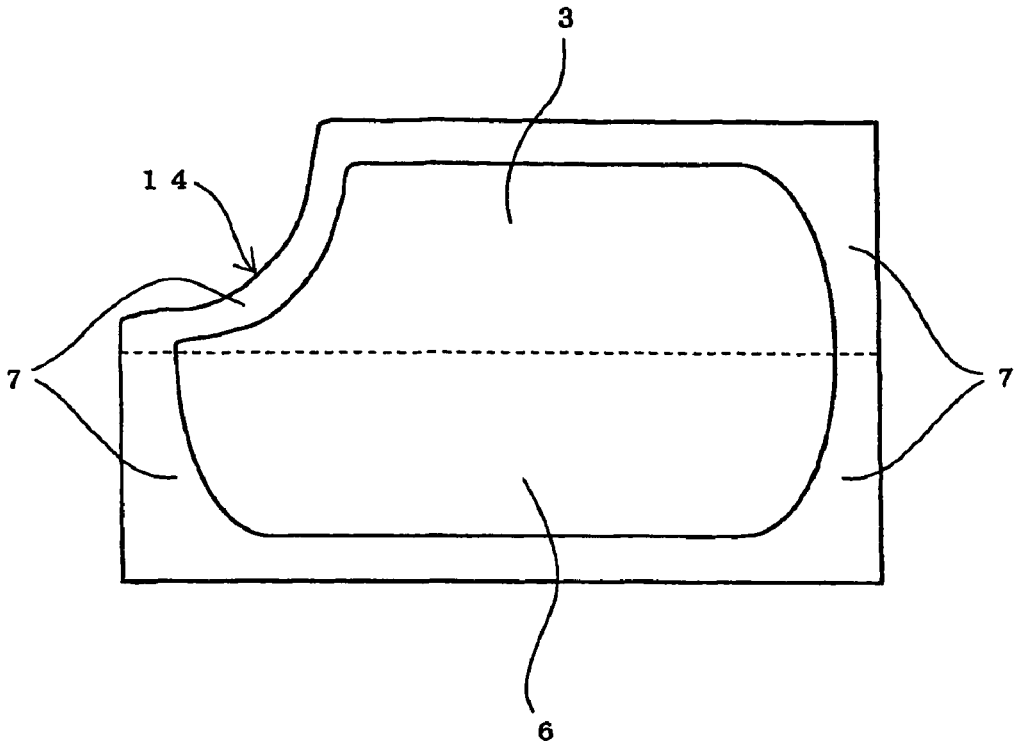
Figure 23:
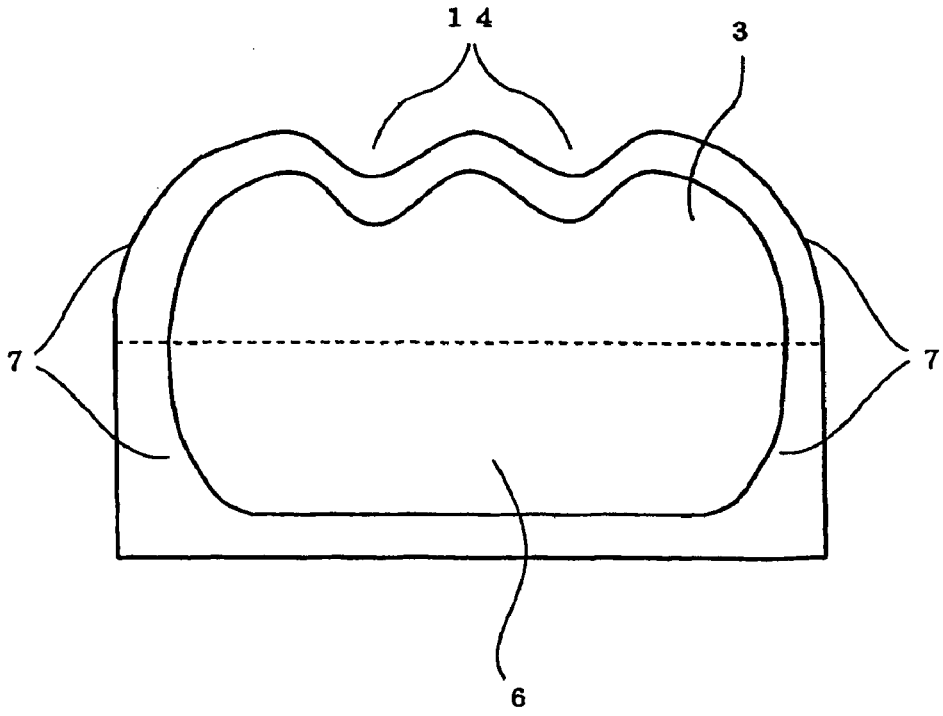

Next, FIG. 16 explains an appropriate height of a branched section of a packaging pouch for a microwave oven according to the present invention, appropriate lengths of sides of the packaging pouch, an appropriate position for providing a vapor release seal part, and the like.

The packaging pouch for a microwave oven according to the present invention preferably has dimensions selected to satisfy the following expressions (1) to (4):

$$D \geqq A+B \quad (1);$$

$$A \geqq C \quad (2);$$

$$B \geqq C \quad (3); \text{ and}$$

$$E \geqq 2A \quad (4),$$

wherein: A represents an inner length of a short side of the opposing section; B represents an inner height of the branched section; C represents a height of a lower end part of the vapor release seal part provided in the branched section; D represents an inner length of a short side of the packaging pouch; and E represents an inner length of a long side of the packaging pouch including the opposing section.

In the case where the dimensions of each parts of the packaging pouch are selected to satisfy such conditions, automatic opening of the packaging pouch under heating in a microwave oven is stabilized. In particular, the inner length E of the long side of the packaging pouch is preferably selected to satisfy $E \geqq 3A$, to thereby further stabilize automatic opening of the packaging pouch.

In each of the above-mentioned examples, one vapor release seal part was provided in the branched section of the packaging pouch, but plural vapor release seal parts may be formed in the branched section thereof. Further, in the case where the weakened part is formed by providing a notch or through-hole in the vapor release seal part, an unsealed part may be provided between the notch or through-hole and the seal part to prevent an effect of impact on the vapor release seal part during formation of the weakened part. Note that the shape or dimensions of each of the packaging pouch, branched section, opposing section, vapor release seal part, opening preventive means, and the like may obviously be selected arbitrarily.

FIGS. 17 to 23 are each a schematic diagram showing an example of a branched section and an opposing section of a packaging pouch according to the present invention. Reference numerals in FIGS. 17 to 23 are the same as the reference numerals of the packaging pouches described above. Note that the packaging pouch of the present invention may obviously also take different modes from those described above.

Next, the packaging pouch for a microwave oven according to the present invention will be described with reference to examples. However, the present invention is not limited to following specific examples.

EXAMPLE 1

A rolled laminate was produced through dry lamination by using a silica-deposited biaxially oriented polyester film having a thickness of 12 μm, a biaxially oriented nylon film having a thickness of 15 μm, and a propylene film having a thickness of 70 μm in the order given from an outer layer and by using a polyurethane-based adhesive between the films.

The laminate was set in a pouch making machine such that the propylene layer was arranged inside the pouch, to thereby produce a pouch having a branched section as shown in FIG. 1. The opening preventive means 7 were provided in each of the branched section 3 and the opposing section 6. The dimensions of each part as shown in FIG. 16 are as follows. A=54 mm, B=54 mm, C=39 mm, D=118 mm, and E=156 mm.

COMPARATIVE EXAMPLE 1

A pouch having a branched section was produced in the same manner as in Example 1 except that the opening preventive means 7 was provided in the branched section 3 alone.

COMPARATIVE EXAMPLE 2

A pouch having a branched section was produced in the same manner as in Example 1 except that no opening preventive means 7 was provided in the branched section 3 or the opposing section 6.

The pouch having a branched section obtained in each of Example 1 and Comparative Examples 1 and 2 was sealed after 200 g of curry was filled thereinto from the filling port 10, and was subjected to retort sterilization at 120° C. for 30 minutes. One hundred (100) pouches were prepared for each of Example 1 and Comparative Examples 1 and 2. Fifty (50) pouches each having a branched section and filled with curry were heated at a rated power of 500 W and 1,500 W, and automatic opening of the seal part and the state of the peripheral edge seal part were observed. Table 1 shows the results.

TABLE 1

| | Example 1 | Comparative Example 1 | Comparative Example 2 |
|---|---|---|---|
| [Power 500 W] | | | |
| Number of pouches automatically opened | 50/50 | 50/50 | 50/50 |
| Total Number of pouches with receding seal part and torn pouches | 0/50 | 8/50 | 50/50 |
| State of peripheral edge seal part | Good | Partly bad | Bad |
| [Power 1500 W] | | | |
| Number of pouches automatically opened | 50/50 | 26/50 | 0/50 |
| Total Number of pouches with receding seal part and torn pouches | 0/50 | 50/50 | 50/50 |
| State of peripheral edge seal part | Good | Partly bad | Bad |

All the pouches of Example 1 automatically opened in a stable manner under heating in a microwave oven at a rated power of 500 W or 1,500 W. No seal part receded at a base part of the branched section, and no torn pouches were observed.

To the contrary, all pouches of Comparative Example 1, each provided with the opening preventive means in the branched section alone, automatically opened under heating in a microwave oven at rated power of 500 W, but the opened state was not stable and the seal part partly receded at the base part of the branched section. Some of the pouches did not automatically open under heating in a microwave oven at a rated power of 1,500 W, and all the pouches were torn from the base part of the branched section. The pouches of Comparative Example 2 provided with no opening preventive means did not automatically open under heating in a microwave oven at rated power of 500 W or 1,500 W, and all pouches were torn from the base part of the branched section.

The peripheral edge seal part and the vapor release seal part of the packaging pouch for a microwave oven according to the present invention having the above-mentioned structure each have a sealing strength of 2.3 kg/15 mm width or more.

The conventional packaging pouch which automatically opens during heating in a microwave oven has an opened part with a significantly reduced sealing strength under heating and cannot attain a sealing strength of 2.3 kg/15 mm width or more required for a retort food packaging pouch. In the packaging pouch for a microwave oven according to the present invention, a material having a reduced sealing strength under heating is not used for or a work process is not applied to a seal part itself of the peripheral edge seal part or the vapor release seal part. Thus, the sealing strength may be maintained.

Further, the packaging pouch of the present invention is provided with the opening preventive means on an inner side of the peripheral edge seal part of each of the branched section and the opposing body of the packaging pouch, to thereby prevent opening of the pouch from the base part of the branched section or tear of the pouch during retort treatment after the content is filled into the packaging pouch or during heat-cooking of the packaging pouch with a high power microwave oven. Further, the packaging pouch of the present invention is capable of preventing tear of the pouch during transportation or storage.

Further, in the packaging pouch of the present invention, the vapor release seal part maintains a sealing strength for a predetermined time under heat-cooking in a microwave oven, and an inner pressure of the packaging pouch increased by water vapor is maintained, to thereby provide a heat steaming effect on the content. As a result, the packaging pouch of the present invention provides significant effects of improving a flavor of the content and shortening a heat-cooking time.

The invention claimed is:

1. A packaging pouch for a microwave oven, which is hermetically sealed by heat-sealing a plastic film, comprising: a packaging pouch body and a branched section, the packaging pouch body and the branched section having first and second sides; and a vapor release seal part having at least one weakened part formed in the branched section, characterized in that opening preventive means are formed separately from one another on an inner side of a peripheral edge seal part of both sides of each of the branched section and an opposing section of the packaging pouch body opposing the branched section, wherein the peripheral edge seal part and the vapor release seal part each have a sealing strength of 2.3 kg/15 mm or more.

2. The packaging pouch for a microwave oven according to claim 1, characterized in that the vapor release seal part is formed continuously with respect to the peripheral edge seal part of the branched section.

3. The packaging pouch for a microwave oven according to claim 1, characterized in that the vapor release seal part is formed separately from the peripheral edge seal part of the branched section.

4. The packaging pouch for a microwave oven according to claim 1, characterized in that the vapor release seal part is provided with a through-hole, a semi through-hole, or a slit to thereby form a weakened part.

5. The packaging pouch for a microwave oven according to claim 1, characterized in that a notch is formed in the branched section of the packaging pouch inwardly into the pouch and a periphery edge of the notch is heat sealed to thereby form the vapor release seal part having the weakened part.

6. The packaging pouch for a microwave oven according to claim 1, characterized by satisfying the following expressions (1) to (4):

$$D \geqq A+B \quad (1);$$

$$A \geqq C \quad (2);$$

$$B \geqq C \quad (3); \text{ and}$$

$$E \geqq 2A \quad (4),$$

wherein: A represents an inner length of a short side of a packaging pouch body opposing the branched section; B represents an inner height of the branched section; C represents a height of a lower end of the vapor release seal part provided in the branched section; D represents an inner length of a short side of the packaging pouch; and B represents an inner length of a long side of the packaging pouch comprising the section opposing the branched section.

7. The packaging pouch for a microwave oven according to claim 1, characterized in that the plastic film forming the packaging pouch is heat-sealed to thereby form the opening preventive means.

8. The packaging pouch for a microwave oven according to claim 7, characterized in that the branched section is removed along an outer periphery of the opening preventive means formed in the branched section.

9. The packaging pouch for a microwave oven according to claim 1, characterized in that pouring port forming means is formed at the periphery edge seal part of body of the packaging pouch opposing the branched section.

10. The packaging pouch for a microwave oven according to claim 9, characterized in that laser processing is performed at an intended opening position to thereby form pouring port forming means.

* * * * *

UNITED STATES PATENT AND TRADEMARK OFFICE

CERTIFICATE OF CORRECTION

PATENT NO. : 7,709,771 B2
APPLICATION NO. : 10/570269
DATED : May 4, 2010
INVENTOR(S) : Keizo Kanzaki, Shie Nishimoto and Taketo Sakurai It is certified that error appears in the above-identified patent and that said Letters Patent is hereby corrected as shown below:

On the Title page, left column, delete

Item "(86) PCT No.: PCT/JP2004/001294"

and insert

Item --(86) PCT No.: PCT/JP2004/01294--

Column 7, lines 7-9, delete

"and B represents an inner length of a long side of the packaging pouch comprising the section opposing the branched section."

and insert

--and E represents an inner length of a long side of the packaging pouch comprising the section opposing the branched section.--

Signed and Sealed this

Thirty-first Day of August, 2010

David J. Kappos

David J. Kappos
*Director of the United States Patent and Trademark Office*